US009637881B2

(12) United States Patent
McNally

(10) Patent No.: US 9,637,881 B2
(45) Date of Patent: May 2, 2017

(54) STAND ALONE WATER DEFENCE APPARATUS

(71) Applicant: Simon S. McNally, Lancashire (GB)

(72) Inventor: Simon S. McNally, Lancashire (GB)

( * ) Notice: Subject to any disclaimer, the term of this patent is extended or adjusted under 35 U.S.C. 154(b) by 0 days.

(21) Appl. No.: 14/894,694

(22) PCT Filed: Jun. 18, 2014

(86) PCT No.: PCT/GB2014/000238
§ 371 (c)(1),
(2) Date: Nov. 30, 2015

(87) PCT Pub. No.: WO2014/202936
PCT Pub. Date: Dec. 24, 2014

(65) Prior Publication Data

US 2016/0122962 A1 May 5, 2016

(30) Foreign Application Priority Data

Jun. 18, 2013 (GB) ..... 1310790.9

(51) Int. Cl.
*E02B 3/10* (2006.01)
*E02B 7/00* (2006.01)

(52) U.S. Cl.
CPC ..... *E02B 3/106* (2013.01); *E02B 7/005* (2013.01)

(58) Field of Classification Search
CPC ..... E02B 3/10; E02B 3/106; E02B 7/005
(Continued)

(56) References Cited

U.S. PATENT DOCUMENTS 4,252,461 A * 2/1981 Colamussi ..... E02B 7/005 405/115
4,321,774 A * 3/1982 Fish ..... E02B 7/005 405/115

(Continued)

FOREIGN PATENT DOCUMENTS

DE 102004033962 A1 * 2/2006 ..... E02B 3/102
DE 10 2008 036752 A1 2/2010

(Continued)

OTHER PUBLICATIONS

International Search Report, Oct. 7, 2014, from International Phase of the instant application.

*Primary Examiner* — Frederick L Lagman
(74) *Attorney, Agent, or Firm* — Ingenium Patents LLC; Peter R. Kramer

(57) ABSTRACT

A stand-atone flood barrier apparatus that bolts to the ground through anchor bolts that connects with other stand-alone flood barrier apparatus to make a circuit to protect a person's desired location they wish to protect against flood waters such as crop fields. The stand-alone zigzag sheeting then is protracted from the stand-alone base unit and opened out for the end of sheeting to then fix into the retractable/expandable floor grip which is to be fully extended from the main unit which the zigzag sheeting fixes into. The stand-alone apparatus & zigzag sheeting can be retracted back into the stand-alone main unit and locked for further use in the future. Also can be detached from the anchor bolts and stored or used elsewhere. Underneath the stand-alone main unit there is a spike running through the center to keep away surface water. There is also a soft large rubber strip along the full base of the stand-alone unit to tolerate any undulations in the earth beneath the stand-alone apparatus. The stand-alone can be reused until sufficient use makes it no longer
(Continued)

Figure 1:
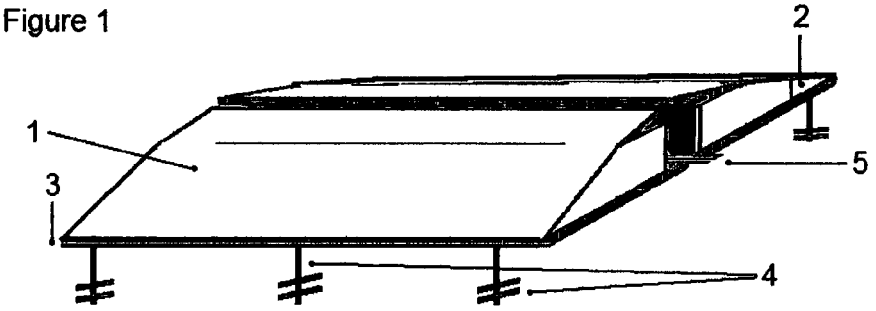

capable of propelling water from the desired locations you wish to protect & recycled.

7 Claims, 3 Drawing Sheets

(58) Field of Classification Search
USPC ..... 405/107, 114, 115
See application file for complete search history.

(56) References Cited

U.S. PATENT DOCUMENTS 4,458,456 A * 7/1984 Battle ..... E04H 9/145 405/115
5,154,537 A * 10/1992 DeVries ..... E02B 3/02 405/211
5,988,946 A * 11/1999 Reed ..... E02B 3/102 405/114
6,216,399 B1 * 4/2001 Belarbi ..... E02B 3/104 160/23.1
6,425,707 B1 * 7/2002 Baxter ..... E04H 9/145 405/104
7,690,865 B1 * 4/2010 Stewart ..... E04H 9/145 405/114
7,972,081 B2 * 7/2011 Linares ..... E02B 3/104 256/13
8,287,209 B2 * 10/2012 Feldman ..... E02B 3/06 405/111
8,500,365 B1 * 8/2013 Vecherin ..... E04H 9/145 405/110
8,523,485 B2 * 9/2013 Higginson ..... E02B 3/104 405/115
2004/0096275 A1 * 5/2004 Rorheim ..... E02B 3/102 405/107
2009/0064598 A1 * 3/2009 Mouyiaris ..... E02B 3/108 52/2.11
2010/0322712 A1 * 12/2010 Higginson ..... E02B 3/104 405/115
2013/0302092 A1 * 11/2013 Ortiz ..... E06B 9/00 405/36
2015/0096232 A1 * 4/2015 Cadogan ..... E06B 9/13 49/10

FOREIGN PATENT DOCUMENTS

WO WO 2009/109735 A1 9/2009
WO WO 2011/159146 A1 12/2011

* cited by examiner

STAND ALONE WATER DEFENCE APPARATUS

This invention relates to a device apparatus to protect from flood waters.

Floods waters are everywhere, and with no easy way of protecting yourself except by using thousands of sandbags or huge big trenches around the area you want to protect so as to bury water defense systems into the ground that costs more money, than what you want to protect is worth. Also the costing of labour to have them fitted has to be added.

The stand alone water defense apparatus attaches to the ground with anchor bolts with no digging or holes needed.

Oblong in shape when fitted, the unit when opened and zigzag concertina sheeting protracted from the stand alone base unit, which is then opened out for the top of sheeting to then fix into the retractable/expandable floor grip which is to be fully extended from the side of the main unit. The zigzag concertina sheeting then fixes into, and stands on its own securely and rigidly. So when attached to one another, a circuit is made of numerous stand alone apparatus. It protects whatever you have located on the interior of the stand alones fitted together such as crop fields or anything else you wish to protect. There is a small spike running the length beneath the stand alone main unit also a soft large rubber strip along the full base of the stand alone unit to tolerate any undulations in the earth beneath the stand alone apparatus and to stop any surface water getting under the stand alones main units.

This invention is a stand alone water defense apparatus, Oblong in shape and anchored to the ground. The main apparatus stores and all water defense equipment, including zigzag concertina sheeting, which is removed when needed & replaced and locked back into the main unit when not in use. The bottom of the zigzag concertina sheeting stays attached to the interior of the base unit by rails/runners, so movement to attach to other units can be achieved. The stand alone defense apparatus is fitted together side by side and the contents protracted from the main stand alone unit which opens out to show strong sheeting in a zigzag concertina formation for added strength, which then opens out and attaches to the next stand alones zigzag sheeting which has been protracted from that unit and so on.

They then open out at a specific point of the zigzag sheeting midway. With which the folded out top half of the zigzag sheeting, then fits into extendable/retractable grip that extends out of the main stand alone unit at the side, which then further grips into the ground the more force of water is increased upon the main sheeting structure.

Different heights of the zigzag sheeting apparatus can be used to suit your desired height you wish to protect. Also different stand alone unit lengths can also be used as well as corner units. Along with units at a slight angle, so then can be fitted in a circle.

These units are re-useable. And all sheeting retracts and folds back into the stand alone base unit with the top closed and locked when not in use or even detached from main ground anchor bolts and stored or used elsewhere.

FIGURES

FIG. 1 The stand alone frontals view of the water defense system.

Figure 2:
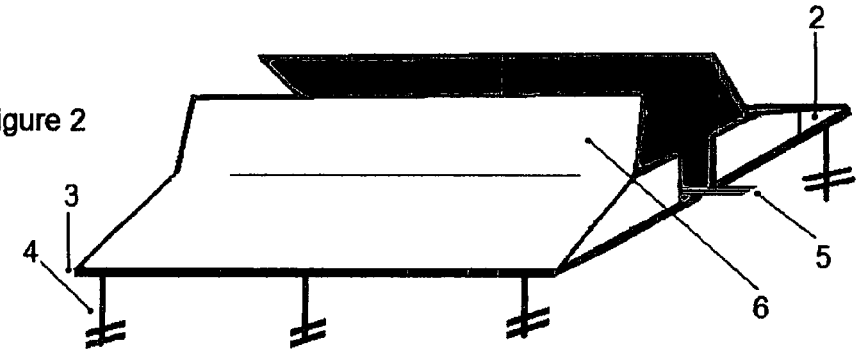

FIG. 2 The stand alone opening to show defense zigzag design of the sheeting.

Figure 3:
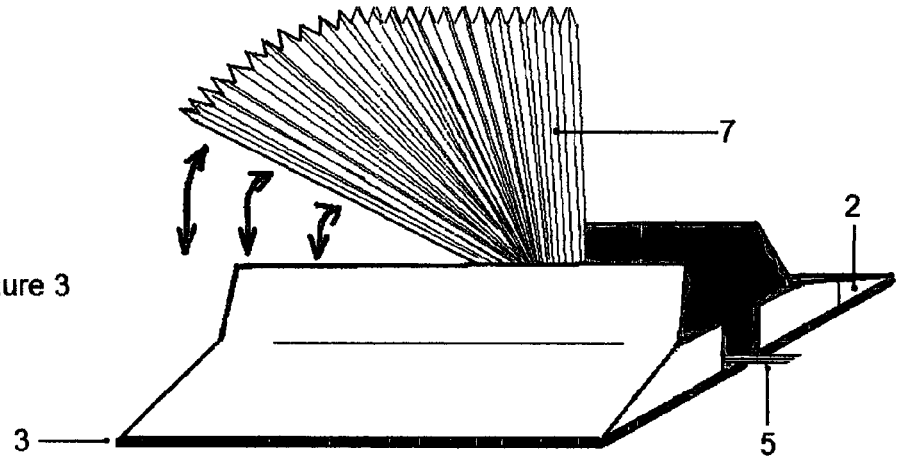

FIG. 3 The stand alone zigzag sheeting being protracted from the main unit.

Figure 4:
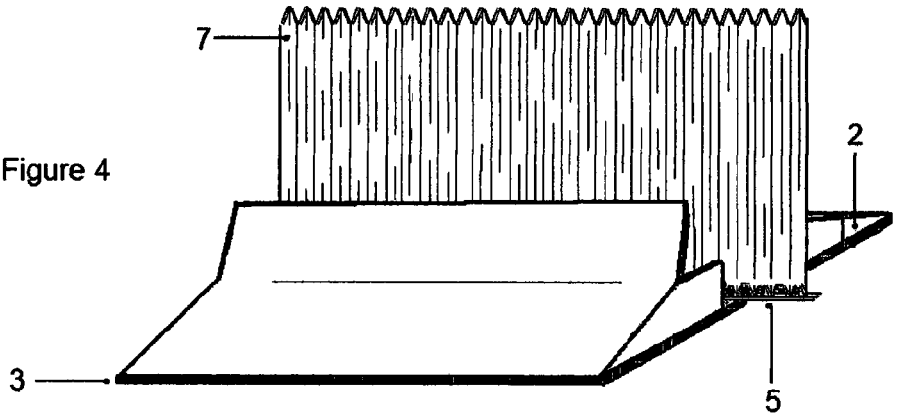

FIG. 4 The stand alone zigzag sheeting opened and expanded on rails to attach to other units.

Figure 5:
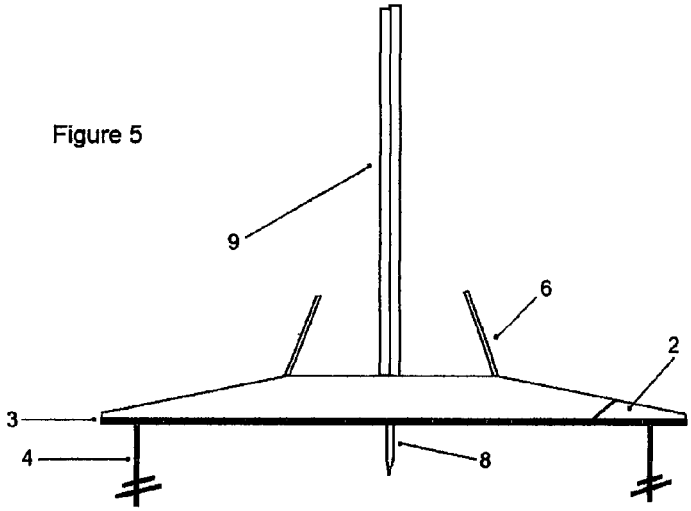

FIG. 5 The stand alone side view with interior protracted also showing at the base of the unit, the anchor bolts, the base rubber strip and the surface water spike.

Figure 6:
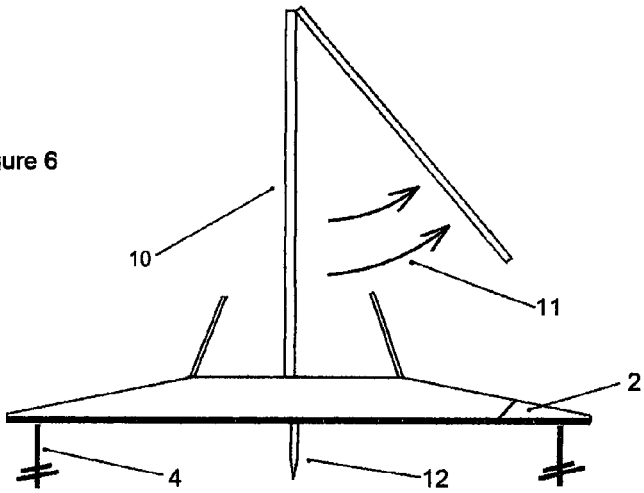

FIG. 6 The stand alone showing the zigzag sheeting opened.

Figure 7:
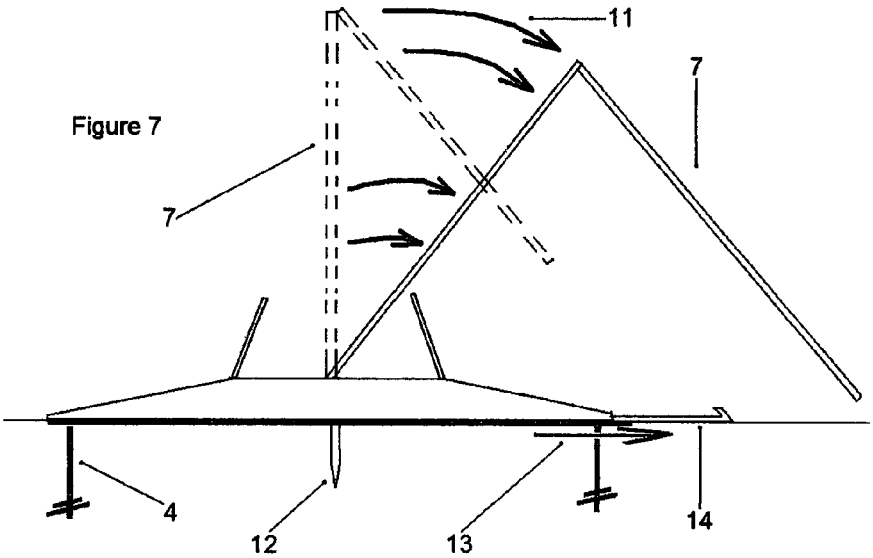

FIG. 7 The stand alone showing the direction and the base unit grip to affix the expanded unit to.

Figure 8:
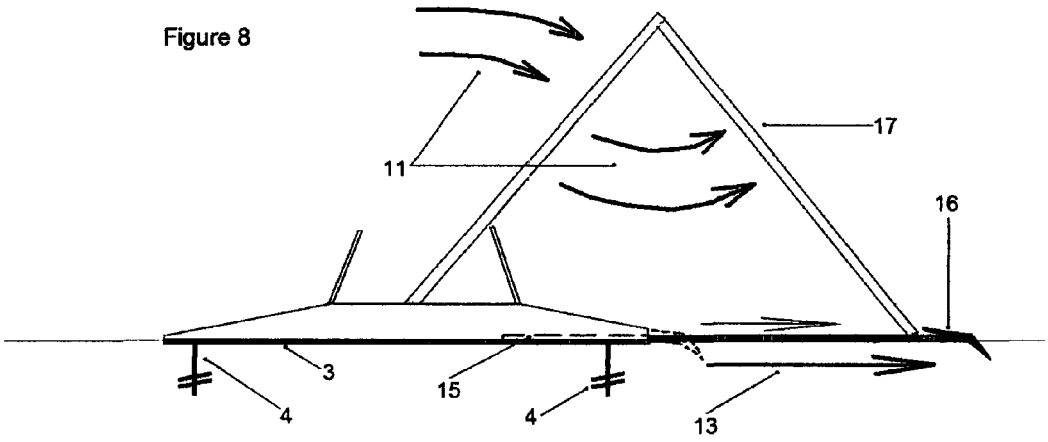

FIG. 8 The stand alone fully protracted showing directions of all protracted parts.

Figure 9:
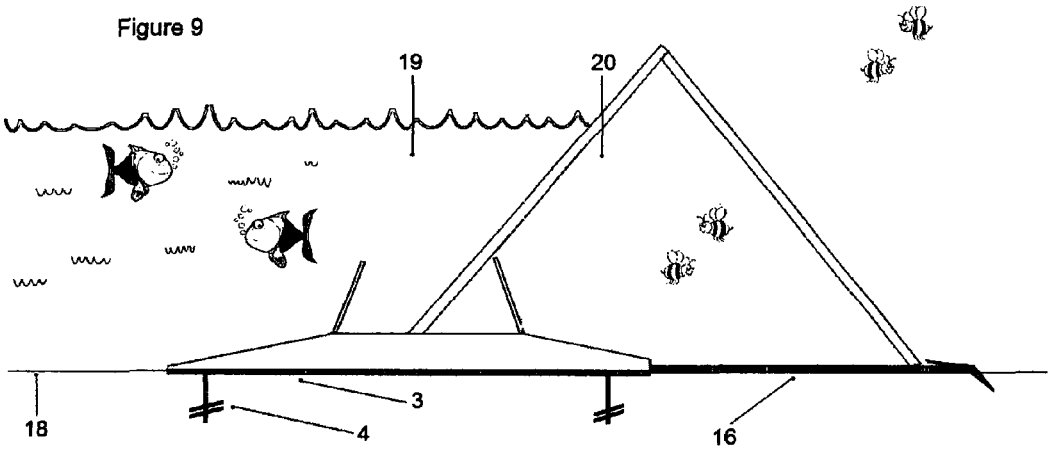

FIG. 9 The stand alone finally in use.

Figure 10:
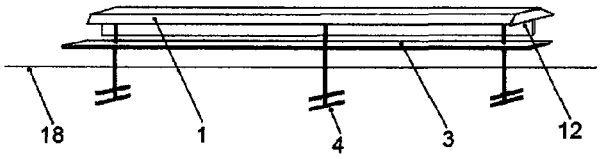

FIG. 10 The stand alone side view of fully retracted unit with thick rubber strip, anchor bolts & surface water strip.

Figure 11:
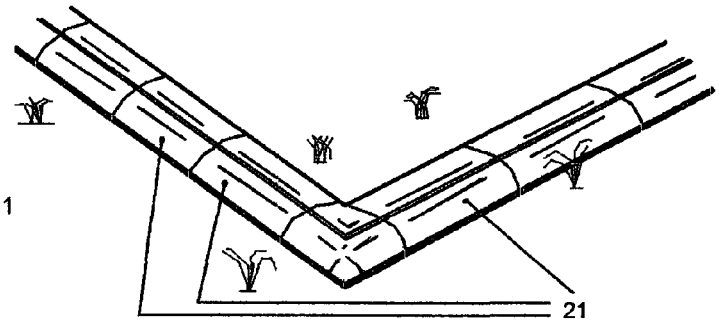

FIG. 11 The stand alone being fitted side by side, next to one another, being all attached making a full circuit.

NUMBERED POINTS

1. The main stand alone unit.
2. The Retractable/Expandable floor grip, to place fully the protracted stand alone zigzag sheeting onto.
3. Base rubber seal. To protect against ground surface water and undulations in the ground.
4. Anchor Bolts to keep the stand alone fixed solidly into place.
5. Rail to run the length of the base unit, which the base of the stand alone zigzag sheeting is fixed to at ground level.
6. Stand alone unit being partially opened and fully opened.
7. The stand alone zigzag sheeting being protracted from the main unit & into position.
8. Surface water spike. Stopping any water getting under the stand alone in damp soil.
9. Protracted zigzag sheeting from base stand alone unit.
10. Sheeting being opened out.
11. Arrows to show the correct direction of the zigzag sheeting when being protracted from the stand alone base unit.
12. The surface water spike, keeping any other surface water away.
13. Arrows to show the direction of the expandable grip for the top of the stand alone sheeting to slot into when fully protracted and folded.
14. The expandable grip, expanded for the top of the stand alone zigzag sheeting to fit into.
15. The expandable grip location when fully retracted.
16. The expandable grip fully extended.
17. Stand alone sheeting fully opened and into place.
18. Ground level.
19. Water.
20. The stand alone working and keeping water back and away from the area where the stand alones are protecting.
21. Stand alone fitted to the ground and not in use.

DETAILED DESCRIPTION

The stand alone water defense apparatus attaches to the ground with anchor bolts without digging holes. Oblong in shape, the stand alone unit when opened and zigzag concertina sheeting protracted from the stand alone base unit (See FIGS. 5, 6 & 7) then opened out with the top of sheeting, slotting into the retractable/expandable floor grip which is now to be fully extended from the side of the main unit. The zigzag concertina sheeting slots into the grip to secure the zigzag concertina sheeting and stands on its own becoming rigid, the more force of water, pushes the grip further into the ground making the sheeting structure more secure. (See FIGS. 8 & 9 No. 16).

The stand alone zigzag sheeting, slides along once attached to the rails at the base of the standalone base unit as a concertina, which then attaches to other standalone zigzag sheeting, or folded to collapse like a concertina and locked in the standalone base unit. The zigzag sheeting when either fitted on there own or attached to other standalone units are all rigid to propel water. (See FIGS. 3 & 4)

When a circuit is made of numerous stand alone apparatus, side by side, it protects your area you wish to protect from flood water such as crop fields The main stand alone unit apparatus contains the flood protection prevention zigzag sheeting, which is protracted when needed & retracted back into the main stand alone unit when not in use, then closed and locked for safe keeping until needed again. Also can be detached from the main anchor bolts by locking clips and stored in a safe place, or move the stand alone units to another location and attach to other anchor bolts you have fitted in other needed locations.

The main stand alone unit which opens out to show strong sheeting in a zigzag concertina formation for added strength (See figures from 6 to 9) which then attaches to the next stand alones zigzag sheeting which has been protracted from that unit and so on.

The bottom of the zigzag concertina sheeting stays attached to the interior of the base unit by rails/runners, so movement to attach to other units can be achieved.

There is a soft large rubber strip and small spike along the full base of the stand alone unit to tolerate any undulations in the earth beneath the stand alone apparatus or any surface water.

Different heights of the zigzag sheeting apparatus can be used to suit your desired height you wish to protect. Also different stand alone unit lengths can also be used as well as corner units.

All the stand alone apparatus are re-useable. And all sheeting retracts and folds back into the stand alone base unit with the top closed and locked when not in use or even detached from main ground anchor bolts and stored or used elsewhere.

I claim:

1. A water defence apparatus to be placed on a ground surface comprising, zigzag concertina sheeting having a bottom edge and a top edge, an oblong hollow body portion comprising a rail located within and is oriented along a length of the body, said apparatus configured so that when in use said oblong hollow body lies along the surface of the ground, an extendable grip, wherein the sheeting is attached to the rail by its bottom edge, such that the sheeting can be moved to a folded position for storage within the body portion, and an in use position where the sheeting is unfolded and the top edge of the sheeting is attached to the extendable grip, said concertina sheeting oriented so that it can expand horizontally along a length of the rail, said extendable grip configured such that a direction of extension is perpendicular to the length of the rail and parallel to the surface of the ground.

2. The water defence apparatus according to claim 1 further comprising, detachable main anchor bolts, said detachable anchor bolts configured to bolt said hollow body portion to the ground.

3. The water defence apparatus according to claim 2, comprising wherein said oblong hollow body portion and said zigzag concertina sheeting are comprised of waterproof material, and with said apparatus further configured such that said detachable anchor bolts can be attached to said oblong hollow body portion with the bolts extending through a base of the body and with a head of the bolts being attached to an interior base of the body with the tips of the bolts extending beneath the apparatus.

4. The water defence apparatus according to claim 3 wherein said oblong hollow body portion comprises a storage device for storing all the water defence apparatus components including zigzag concertina sheeting, which can be opened to allow the waterproof sheeting to be deployed.

5. The water defence apparatus according to claim 4 further comprising, a rubber strip, said rubber strip being on an exterior surface of the apparatus and with said rubber strip being located below the base of the oblong hollow body portion.

6. A method of using an above ground water defence apparatus comprising, placing a water defence apparatus on a surface of a ground, said water defence apparatus having an oblong hollow body portion comprising a rail located within and said rail being oriented along a length of the body, wherein said oblong hollow body portion lies along the surface of the ground, said water defence apparatus further having zigzag concertina sheeting having a bottom edge and a top edge, said concertina sheet having elongated flat segments that are joined by folds, and said elongated flat segments being adjacently arranged in lengthwise fashion, swinging out said concertina sheeting to change the spacial orientation of said concertina sheeting by a 90 degree angle such that said elongated segments are perpendicular to said rail and said bottom edge of said concertina sheeting is anchored to the rail, expanding said concertina sheeting horizontally along the length of the rail while keeping said elongated segments substantially perpendicular to said rail.

7. The method according to claim 6 further comprising, orienting and attaching detachable anchor bolts so that the anchor bolts extend below said hollow body, anchoring said hollow body to the ground using said detachable main anchor bolts.

* * * * *